US008590476B2

(12) United States Patent
Goudeau et al.

(10) Patent No.: US 8,590,476 B2
(45) Date of Patent: Nov. 26, 2013

(54) SYSTEM FOR AUTOMATICALLY LAUNCHING AND RETRIEVING AN UNDERWATER DRONE

(75) Inventors: Jean-Philippe Goudeau, Le Rouret (FR); Hervé Le Gras, Roquefort les Pins (FR); Rémi Ruvio, Antibes (FR)

(73) Assignee: Thales, Neuilly sur Seine (FR)

( * ) Notice: Subject to any disclaimer, the term of this patent is extended or adjusted under 35 U.S.C. 154(b) by 228 days.

(21) Appl. No.: 12/995,982

(22) PCT Filed: Jun. 3, 2009

(86) PCT No.: PCT/EP2009/056821

§ 371 (c)(1),
(2), (4) Date: Mar. 10, 2011

(87) PCT Pub. No.: WO2009/147176

PCT Pub. Date: Dec. 10, 2009

(65) Prior Publication Data

US 2011/0192338 A1 Aug. 11, 2011

(30) Foreign Application Priority Data

Jun. 3, 2008 (FR) ..... 08 03058

(51) Int. Cl.
*B63G 8/41* (2006.01)
*B63C 7/00* (2006.01)
*G05D 3/00* (2006.01)

(52) U.S. Cl.
USPC ..... 114/322; 114/51; 701/21

(58) Field of Classification Search
USPC ..... 114/322, 312, 51; 701/21
See application file for complete search history.

(56) References Cited

U.S. PATENT DOCUMENTS

| | | | | |
|---|---|---|---|---|
| 3,732,838 | A * | 5/1973 | Kriedt et al. | 114/333 |
| 5,995,882 | A * | 11/1999 | Patterson et al. | 701/21 |
| 6,167,831 | B1 * | 1/2001 | Watt et al. | 114/322 |
| 6,390,012 | B1 * | 5/2002 | Watt et al. | 114/322 |
| 8,437,885 | B1 * | 5/2013 | Beazley et al. | 701/2 |
| 2008/0300742 | A1 * | 12/2008 | Weaver et al. | 701/21 |
| 2009/0308299 | A1 * | 12/2009 | Luccioni et al. | 114/230.23 |
| 2010/0018449 | A1 * | 1/2010 | Luccioni et al. | 114/322 |

FOREIGN PATENT DOCUMENTS

| | | | |
|---|---|---|---|
| DE | 41 40 201 | A1 | 6/1993 |
| JP | 8-282588 | A | 10/1996 |
| WO | 2004/065206 | A1 | 8/2004 |
| WO | 2008/012472 | A1 | 1/2008 |

* cited by examiner

*Primary Examiner* — Lars A Olson
*Assistant Examiner* — Andrew Polay
(74) *Attorney, Agent, or Firm* — Baker Hostetler LLP

(57) ABSTRACT

The present invention relates to systems for launching and retrieving underwater craft from a ship. It consists mainly of a handling cradle for launching and retrieving an underwater vehicle, comprising a frame forming a dorsal ridge and providing an interface between lifting means, a crane for example, and the underwater vehicle. This frame comprises: means for adjusting the overall buoyancy; means for automatically aligning the vehicle with the dorsal ridge formed by the frame; means for grasping the vehicle from the surface after the frame has been aligned with the vehicle. In a preferred embodiment, the cradle comprises an onboard video camera enabling the operator onboard the ship to ensure that the vehicle attachment and release operations are carried out correctly. The invention advantageously allows the vehicle to be launched and retrieved automatically when the vehicle is under the surface in an area where it is not subject to the effects of the swell.

18 Claims, 5 Drawing Sheets

SYSTEM FOR AUTOMATICALLY LAUNCHING AND RETRIEVING AN UNDERWATER DRONE

CROSS-REFERENCE TO RELATED APPLICATIONS

This application is a National Stage of International patent application PCT/EP2009/056821, filed on Jun. 3, 2009, which claims priority to foreign French patent application No. FR 0803058, filed on Jun. 3, 2008, the disclosures of which are incorporated by reference in their entirety.

FIELD OF THE INVENTION

The present invention relates to the general field of the handling, loading and unloading of objects from a transport platform. More particularly, it relates to the systems for launching and retrieving underwater craft from a ship.

BACKGROUND

The handling of a unmanned underwater vehicle, by a transport platform, a ship for example, has hitherto generally required the intervention of human operators. A lifting tool is generally used, of crane type, available onboard for various lifting operations. This lifting tool can be used simply to move the underwater vehicle on the platform, to deposit it on the surface of the water and to raise it back onboard from the surface.

During launching, the attaching of the vehicle to the crane and then its release are then performed manually by operators responsible for handling. A team positioned on the deck of the platform attaches the vehicle to the crane cable and a team positioned onboard a light craft, of inflatable craft type for example, releases the vehicle while the latter is floating on the surface.

Conversely, during the retrieval of the vehicle, a team positioned onboard a light craft attaches the vehicle from the surface, while a team positioned on the deck of the platform releases the vehicle.

This type of handling, in addition to the fact that it involves a large number of operators, also has the drawback that attachment and release operations must be carried out while the vehicle is on the surface and it is therefore subject to wave movement. Consequently, launching and retrieving a vehicle in heavy weather is difficult. First of all, it requires the operators to perform attachment and release operations in heavy weather, from a light craft which is ill suited to this type of weather. Then, it requires the underwater vehicle to be positioned on the surface in proximity to the platform while the movement of the waves makes it impossible to maintain a fixed position.

Consequently, in heavy weather, launching and retrieving the underwater vehicle becomes perilous both at the human level through the danger to which the operators responsible for handling are subject, and at the equipment level through the risk of damage by collision both to the transport platform and the light craft and to the underwater vehicle. Thus, the use of the underwater vehicle in all weathers is generally handled from a dedicated platform, equipped with specific means closely adapted to the vehicle concerned, enabling the vehicle to be attached and released automatically.

SUMMARY OF THE INVENTION

One aim of the invention is to propose a solution making it possible to employ an underwater vehicle from a transport platform without requiring the intervention of handlers in order, from a light craft, to attach the vehicle to the lifting means with which the platform is equipped and then release it. Another aim of the invention is to propose a solution that makes it possible to carry out these operations while limiting the risks of collision between the platform and the underwater vehicle when the latter is in proximity to the platform. To this end, an object of the invention is a handling cradle for launching and retrieving an underwater vehicle, comprising a frame forming a dorsal ridge and providing an interface between lifting means and the underwater vehicle. According to the invention, the frame comprises:

- means for adjusting the overall buoyancy;
- means for automatically aligning the vehicle with the dorsal ridge formed by the frame;
- means for grasping the vehicle after the frame has been aligned with the vehicle.

According to a preferred embodiment of the invention, the means for adjusting the overall buoyancy comprise ballast floats arranged along the frame.

According to another preferred embodiment of the invention, which can be combined with the preceding embodiment, the means for aligning the frame with the underwater vehicle comprise an end piece of conical overall shape arranged at one end of the frame, the end piece being dimensioned and configured to accommodate the front end of the vehicle.

According to another preferred embodiment of the invention, which can be combined with the preceding embodiment, the means for grasping the vehicle comprise two articulated arms arranged on the frame and configured so as to encircle the lateral walls of the vehicle.

Another object of the invention is a remotely-operable handling system for an underwater vehicle, which comprises lifting means associated with a handling cradle according to the invention, the grasping device being connected to the lifting means by an electric pulling cable wound on a winch.

According to a preferred embodiment, the handling system according to the invention also comprises control and monitoring means for ensuring the alignment of the frame with the vehicle and actuating the various means of the handling cradle, the control and monitoring signals being transmitted by the electric towing cable.

According to another preferred embodiment of the handling system according to the invention, which can be combined with the preceding embodiment, the control and monitoring means comprise a camera mounted on the handling cradle configured to view the underwater vehicle during its approach to the handling cradle and during the operations of aligning the frame with the vehicle.

Another object of the invention is a method for launching an underwater vehicle by means of the handling system according to the invention, a method whereby the following operations are carried out in succession:

- positioning the handling cradle containing the vehicle above the water plane;
- lifting down the handling cradle;
- controlling the immersion of the handling cradle to the desired depth;
- releasing of the vehicle: opening the grasping means;
- piloting the departure of the vehicle;
- switching the vehicle to standalone operating mode.

An object of the invention is finally a method for retrieving an underwater vehicle by means of the handling system according to the invention, a method whereby the following operations are carried out in succession:

- switching the vehicle to remote-controlled operating mode;

piloting the approach of the vehicle;

inserting the vehicle into the alignment means of the handling cradle;

keeping the vehicle moving to align the frame with the vehicle;

stopping the vehicle and closing the grasping means;

lifting up the vehicle in the handling cradle;

positioning the handling cradle enclosing the vehicle in the storage area.

The device according to the invention advantageously enables a transport platform, a scientific ship for example, to carry an underwater vehicle, an automatic vehicle of relatively small size for example, and to automatically deploy such a vehicle, even in heavy seas, without requiring manual operations and without risking a collision between the platform and the vehicle. This deployment can also advantageously be performed with simple lifting means.

BRIEF DESCRIPTION OF THE DRAWINGS

The features and advantages of the invention will be better appreciated from the following description which explains the invention through a particular embodiment taken as a nonlimiting example and which is based on the appended figures, which represent.

DETAILED DESCRIPTION

The following description presents the features of the invention through a particular application taken as a nonlimiting example of deployment. The application described here relates to the implementation of handling, launching and retrieving means, remotely operated, suited to a drone-type automatic underwater vehicle.

Figure 1:
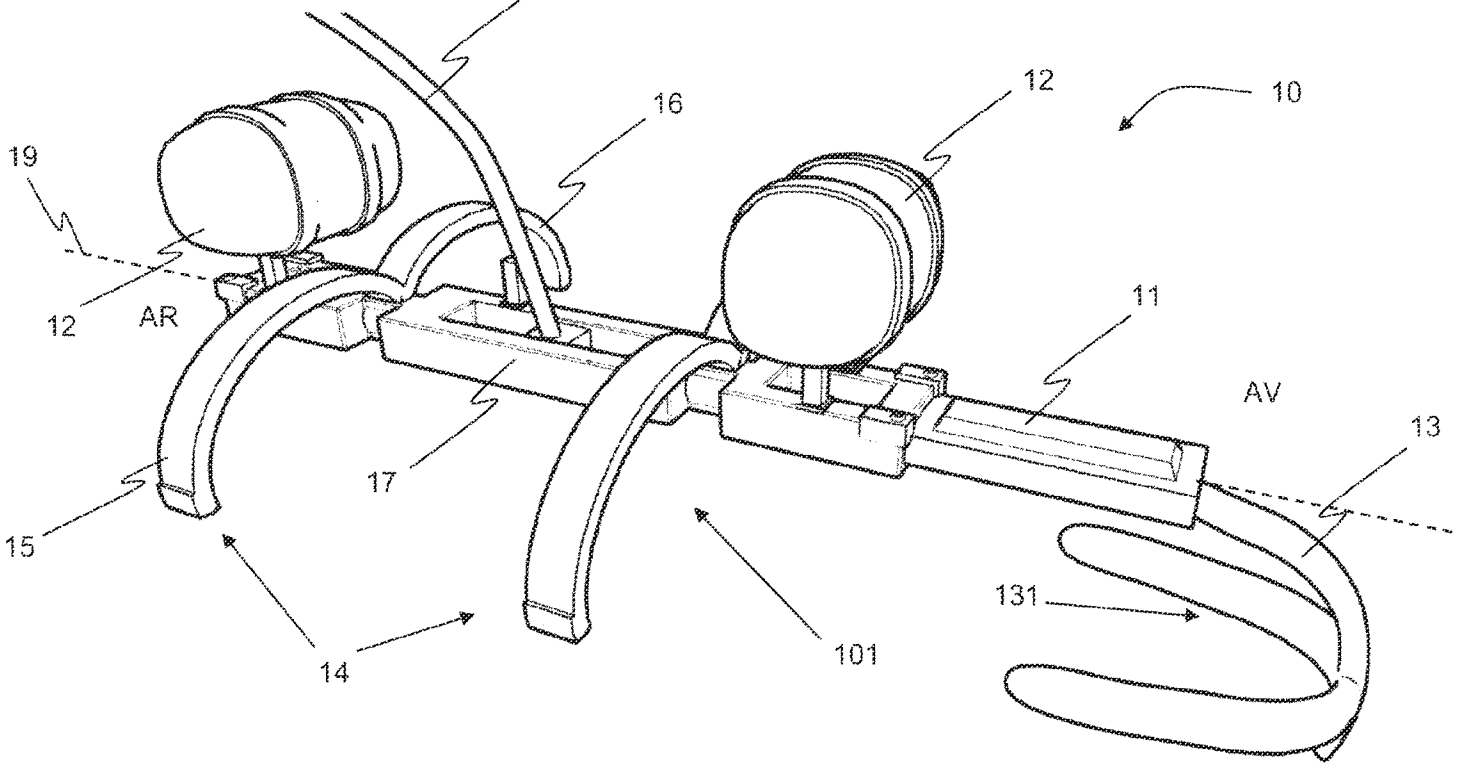
FIG. 1, a schematic representation of the grasping device according to the invention, FIGS. 2, 4 and 6, plan views illustrating the operating principle of the grasping device according to the invention, FIGS. 3, 5 and 7, plan views illustrating the operating principle of the grasping device according to the invention, FIGS. 8 to 10, illustrations relative to a variant embodiment incorporating video means for guiding the vehicle toward the cradle and monitoring its position.

FIG. 1 shows a general view of the handling cradle 10 according to the invention, intended to house the underwater vehicle during launching and retrieval maneuvers. The latter mainly comprises a central frame 11 forming a dorsal ridge and a fixing area 17 where the cradle is attached to a pulling cable 18 used to lift the cradle 10.

Preferably, the cable 18 is attached to the cradle 10, as illustrated by FIG. 1, via an articulated fixing. In this way, when it is suspended at the end of the cable, the cradle 10 can be freely oriented without inflicting excessive twisting on the pulling cable 18.

The central frame 11 supports grasping means 14 distributed along the latter and configured to grip and hold the underwater vehicle. Preferably, these means 14 comprise articulated arms which, on command, encircle the wall of the vehicle by following the profile of this wall. To this end, the grasping means may, for example, consist, as illustrated in the figure, of a plurality of sets of rigid arms in the form of circular arcs 15, 16, articulated at the frame, arranged in opposition to one another and being able, on command, to be lowered to grip the vehicle or be raised to release it. Alternatively, the arms forming each set may consist of a plurality of articulated segments, the latter configuration for example allowing a vehicle whose wall does not have a regular profile to be gripped.

From an operational point of view, the grasping means are actuated when as the underwater vehicle has penetrated into the space 101 delimited by the cradle, it is positioned inside this space so as to be in contact with the frame 11 and to be oriented so that its main axis is parallel to the axis 19 of the frame.

The frame 11 also supports means 13 for enabling automatic positioning of the vehicle inside the space 101 delimited by the cradle, in particular its alignment relative to the axis 19 of the frame. To this end, these means consist of a mechanical structure fixed to the front of the frame, defining a space 131 that can house the front end of the vehicle. According to the invention, the structure 13 has a flared opening enabling the front end of the vehicle to be housed in the housing space 131 even if the vehicle is not strictly aligned with the axis of the frame when it penetrates into the space 101 delimited by the cradle 10. It is arranged so that, when the front end of the vehicle is completely is engaged in the housing space 131, the frame 11 is positioned in contact with the wall of the vehicle or at least at a very short distance from the latter.

Preferably, the means 13 for enabling automatic positioning of the vehicle inside the cradle 10 are associated with complementary means making it possible to check that the vehicle has been correctly positioned in the cradle. These monitoring means, not represented in the figure, can take various forms, the form of devices with electrical contacts or optical devices for example.

According to the invention, the frame 11 also supports means 12 which provide the cradle 10 with the variable buoyancy in water. These means consist, for example as illustrated in the figure, of floats associated with ballasts configured and arranged on the structure so as to confer upon it a horizontal position when it is immersed. Thus, by varying the buoyancy of the floats, it is possible to keep the cradle at a given depth and in a horizontal position. Consequently, the grasping of the underwater vehicle can advantageously be done without the latter having to surface. Consequently, the depth at which the underwater vehicle is grasped can advantageously be chosen so that this operation takes place in calm waters.

FIGS. 2 to 7 present views illustrating at different instants the operating principle of the handling cradle 10 according to the invention during the retrieval of an underwater vehicle 20 by a handling system comprising such a cradle.

Figure 2:
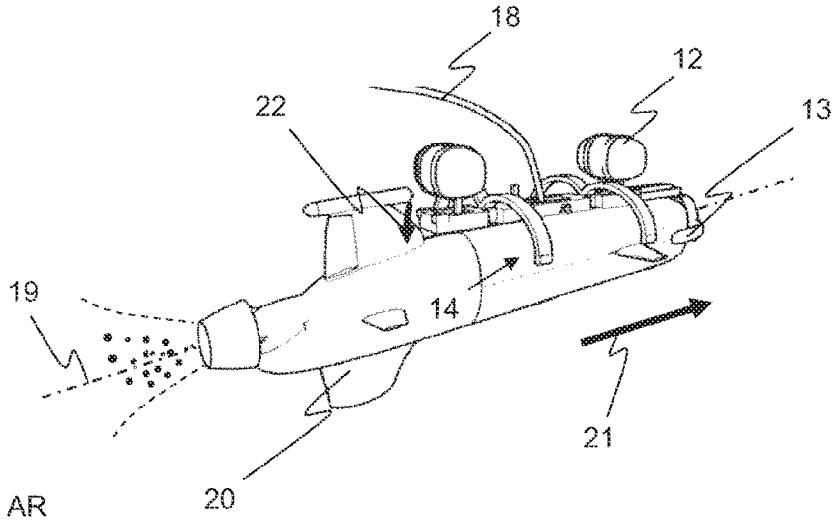
Figure 3:
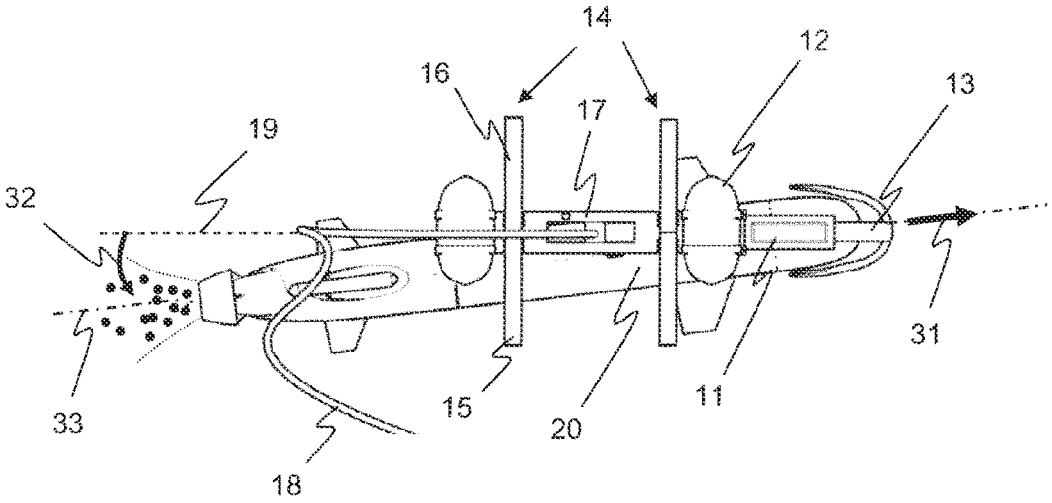

FIGS. 2 and 3 illustrate the phase of the operation during which the operations for both bringing the frame into contact with the vehicle and aligning the frame with the vehicle are carried out.

During this phase, the vehicle 21 is moving. It inserts its front end into the positioning means and drives, in its movement symbolized by the arrows 21 and 31, the cradle 10 whose grasping means 14 are in the raised position. Under the action of the movement impelled by the vehicle and the inertia of the cradle, the latter performs a rotational movement in the horizontal plane and the vertical plane, a movement which has the effect of aligning the axis 19 of the frame 11 on the axis 33 of the vehicle and of bringing the frame 11 toward the wall of the vehicle. The arrows 22 and 32 symbolize these two movements impelled by the driving of the cradle 10 by the vehicle 20. Consequently, at the end of this phase, the underwater vehicle 20 and the cradle are correctly positioned relative to one another so that the actual grasping operation can begin. The vehicle 20 then no longer exerts any propulsion.

Figure 4:
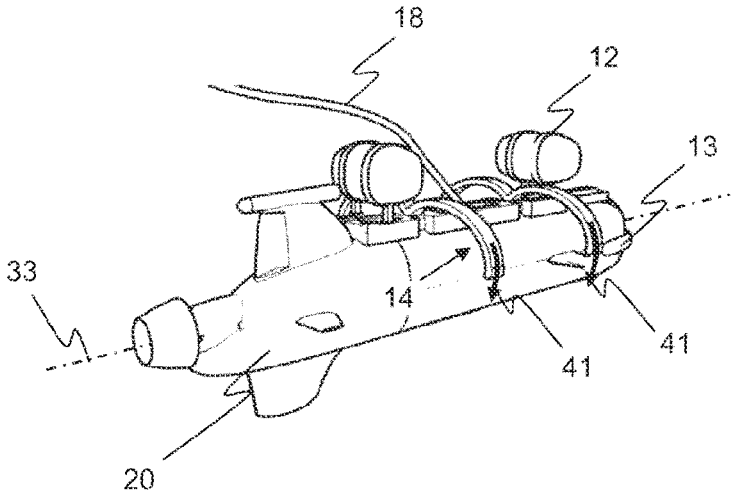
Figure 5:
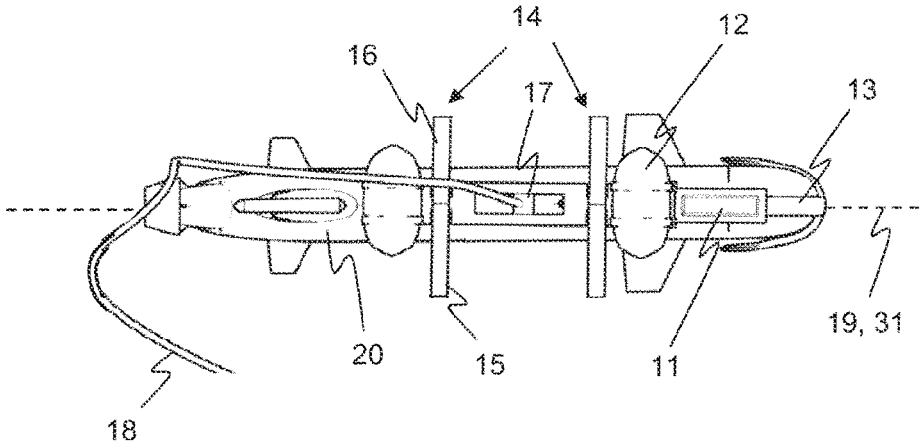

FIGS. 4 and 5 illustrate the beginning of the actual grasping operation. During this phase, the vehicle and the cradle are correctly positioned relative to one another: the axes 19 and 33 are parallel and the frame 11 is in contact with the wall of the vehicle 20. The grasping means 14 are then actuated and the arms 15 and 16 pivot according to a movement symbolized by the arrows 41 to come into contact with the wall of the vehicle on each side of this wall.

Figure 6:
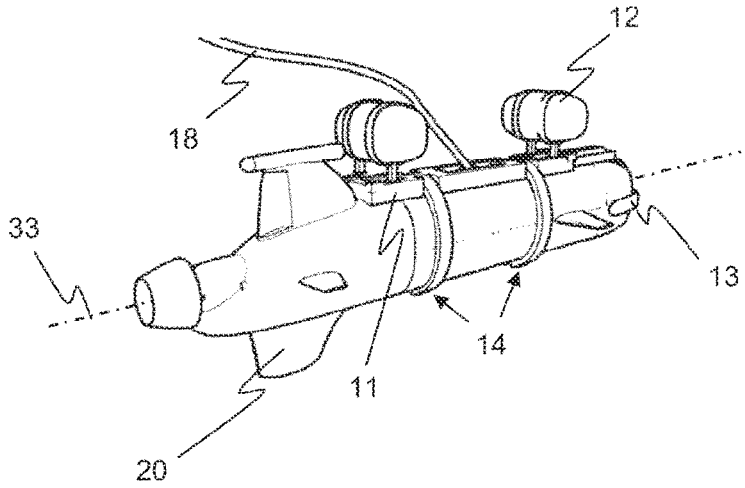
Figure 7:
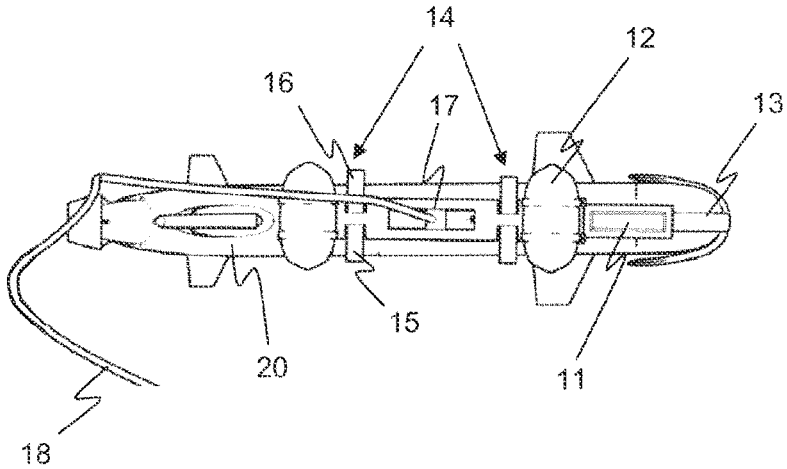

The actual grasping operation continues until the arms 15 and 16 have completely pivoted so that they ultimately form a belt which encircles the vehicle 20 and causes the latter to be firmly attached to the cradle 10 in its movements. This phase of the operation is illustrated by FIGS. 6 and 7.

At this stage, the vehicle-cradle assembly can be raised onboard the transport platform using the lifting means which are not represented here, a crane for example, by winding the cable 19 onto a winch situated onboard the platform.

According to the invention, the cradle 10 therefore constitutes an element of a complete handling system including the cradle 10, the pulling cable 19, the lifting means and monitoring and control means. The function of these means is to allow the various means possessed by the cradle 10 to be employed. The control and monitoring means in particular enable an operator situated onboard to manage the means 12 providing the variable buoyancy of the cradle, to manage the grasping means 14 and to manage control of the winch which actuates the unwinding and winding of the pulling cable 19, actions which cause the cradle 10 to be lifted down and up. In the case where the handling system is in particular intended for the launching and retrieval of an automatic drone-type vehicle, these control and monitoring means may preferably be configured to enable the operator to check the correct positioning of the cradle 10 and of the underwater vehicle 20, in particular before actuating the grasping means 14 during the vehicle retrieval operation. To this end, the cradle 10 is equipped with complementary means configured to transmit to the control and monitoring means information relating to the positioning of the vehicle in the cradle. These complementary means may consist of video means, a camera fixed to the rear of the frame 11 for example. They also facilitate the approach operations of the vehicle 20 toward the cradle 10, an approach which may be performed automatically by the vehicle 20 or conducted from the transport platform by an operator, the vehicle then being remotely controlled from the platform for the cradle linking phase.

Figure 8:
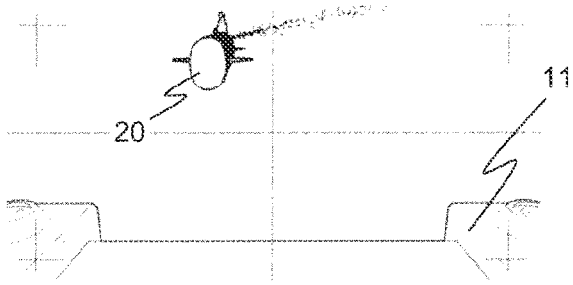
Figure 9:
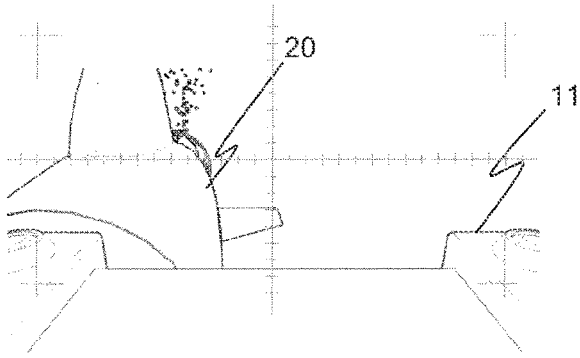
Figure 10:
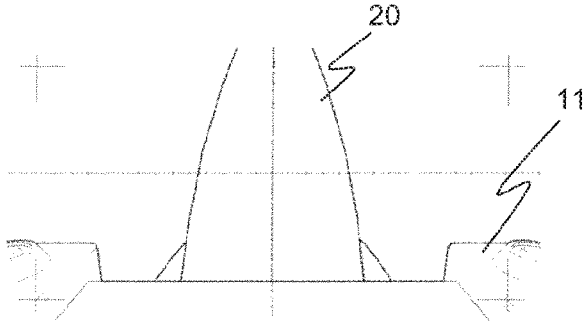

FIGS. 8 to 10 illustrate the manner in which a handling system as described previously and comprising a video camera onboard the cradle 10 can be employed to handle the taking over and retrieval of an automatic underwater vehicle. The figures present views of the underwater vehicle to be retrieved for instants corres-ponding to different phases of the operation. These views obtained from a video camera positioned on the rear end of the frame 11 of the cradle 10 are used by the operator to manage the necessary maneuvers. The procedure for launching the vehicle using this same handling system can also be easily deduced from the procedure used to retrieve it.

In such a context, the vehicle 20 is, for example, positioned at the end of a mission in the vicinity of the cradle 10 which waits for it at a given depth, chosen according to the calm nature of the waters at this depth, then switches to a remote-controlled operating mode. The operator onboard the platform obtains an image similar to that of FIG. 8.

The operator then acts on the navigation and propulsion controls of the vehicle so as to guide the latter toward the cradle and to engage its front end in the positioning means 13. The operator onboard the platform obtains an image similar to that of FIG. 9.

It maintains the propulsion of the vehicle so that the end of the vehicle is entirely housed in the positioning means 13 and so that the cradle 10, driven in the movement of the vehicle, is oriented so that the frame 11 is aligned with the axis of the vehicle. It simultaneously monitors the progress of the maneuvers carried out and of the result obtained on a video camera linked to the video camera positioned at the rear of the frame.

Then, as soon as the vehicle 20 and the frame 11 of the cradle 10 are aligned and in contact with one another, in a situation corresponding to the image of FIG. 10, in which the vehicle is centered, the operator stops the vehicle propulsion system and actuates the grasping means 14, so as to enclose the vehicle in the cradle. The cradle 10 is then raised onboard the transport platform by controlling the winding of the pulling cable 18, and positioned in its storage area by the lifting means.

The exchanges of information and commands between the cradle 10 and the control and monitoring means are handled, conventionally, via the cable 18 which links the cradle to the lifting means. To this end, this cable, called "electric towing cable", may include a plurality of strands intended to fulfill the pulling function and one or more strands forming electrical conductors intended to conduct the signals exchanged by the cradle and the control and monitoring means. Alternatively, it may include strands consisting of optical fibers.

As for the exchanges of commands and information between the vehicle and the control and monitoring means, these may be carried out by any appropriate communication means. In a particular embodiment of the handling system, the communication means may, for example, be installed on the cradle.

Implementing and installing a handling system as described previously is advantageously made simple by the use of the cradle 10 according to the invention, which in itself takes into account most of the specific features of the vehicle 20 to be launched and retrieved. In this way, since the cradle 10 constitutes a true adaptation interface, it is notably useful to install specific lifting and pulling means. Incidentally, the procedures for launching and retrieving an underwater vehicle are also simplified. They can also largely be remotely operated.

Consequently, the method for launching an underwater vehicle by means of the handling system according to the invention implements the following operations in succession:

- positioning the cradle 10 containing the vehicle above the water plane;
- lifting down the empty cradle 10;
- controlling the immersion of the cradle to the desired depth; unwinding the electric pulling cable 18;
- releasing the vehicle 20: opening the grasping means 14;
- remotely piloting the departure of the vehicle 20;
- switching the vehicle 20 to standalone operating mode.

Similarly, the method for retrieving an underwater vehicle by means of the handling system according to the invention implements the following operations in succession:

- switching the vehicle 20 to remote-controlled operating mode;
- piloting the approach of the vehicle;
- inserting the vehicle into the alignment means 13 of the cradle;
- keeping the vehicle moving to align the frame 11 with the vehicle 20;

stopping the vehicle and closing the grasping means 14; attachment;

raising the cradle 10 enclosing the vehicle 20;

positioning the cradle 10 enclosing the vehicle 20 in the storage area.

Implementing such methods advantageously does not assume the intervention of operators to perform attachment and release operations in sometimes perilous conditions.

The invention claimed is:

1. A method for launching an underwater vehicle using a handling cradle, the method comprising the following operations carried out in succession:

receiving the handling cradle for launching and retrieving the underwater vehicle, the handling cradle comprising a frame forming a dorsal ridge, the frame further comprising:

means for adjusting the overall buoyancy of the handling cradle, means for automatically positioning the underwater vehicle in alignment with the dorsal ridge formed by the frame, and means for grasping the underwater vehicle after the frame has been aligned with the underwater vehicle, wherein the means for grasping the underwater vehicle are connected to a pulling cable;

positioning the handling cradle containing the underwater vehicle above the water plane;

immersing the handling cradle in water;

controlling the immersion of the handling cradle to the desired depth using the means for adjusting the overall buoyancy;

releasing the underwater vehicle by opening the means for grasping the underwater vehicle;

piloting departure of the underwater vehicle from the handling cradle; and switching the underwater vehicle to a standalone operating mode.

2. The method as claimed in claim 1, wherein the means for adjusting the overall buoyancy of the handling cradle comprise ballast floats arranged along the frame.

3. The method as claimed in claim 1, wherein the means for automatically positioning the underwater vehicle in alignment with the dorsal ridge formed by the frame comprise an end piece of conical overall shape arranged at one end of the frame.

4. The method as claimed in claim 1, wherein the means for grasping the underwater vehicle comprise two articulated arms arranged on the frame and configured to encircle the lateral walls of the underwater vehicle.

5. The method as claimed in claim 2, wherein the means for automatically positioning the underwater vehicle in alignment with the dorsal ridge formed by the frame comprise an end piece of conical overall shape arranged at one end of the frame.

6. The method as claimed in claim 5, wherein the means for grasping the underwater vehicle comprise two articulated arms arranged on the frame and configured to encircle lateral walls of the underwater vehicle.

7. The method as claimed in claim 6, wherein the means for grasping the underwater vehicle are connected to a pulling cable.

8. The method as claimed in claim 5, wherein the means for grasping the underwater vehicle are connected to a pulling cable.

9. The method as claimed in claim 2, wherein the means for grasping the underwater vehicle are connected to a pulling cable.

10. A method for retrieving an underwater vehicle using a handling cradle, the method comprising the following operations carried out in succession:

receiving the handling cradle for launching and retrieving the underwater vehicle, the handling cradle comprising a frame forming a dorsal ridge, the frame further comprising:

means for adjusting the overall buoyancy of the handling cradle, means for automatically positioning the underwater vehicle in alignment with the dorsal ridge formed by the frame, and means for grasping the underwater vehicle after the frame has been aligned with the underwater vehicle, wherein the means for grasping the underwater vehicle are connected to a pulling cable;

switching the underwater vehicle to a remote-controlled operating mode;

piloting approach of the underwater vehicle to the handling cradle;

inserting the underwater vehicle into the means for automatically positioning the underwater vehicle in alignment with the dorsal ridge formed by the frame;

keeping the underwater vehicle moving to position the underwater vehicle in alignment with the dorsal ridge formed by the frame;

stopping the underwater vehicle;

closing the means for grasping the underwater vehicle;

raising the underwater vehicle in the handling cradle; and positioning the handling cradle enclosing the underwater vehicle in a storage area.

11. The method as claimed in claim 10, wherein the means for adjusting the overall buoyancy of the handling cradle comprise ballast floats arranged along the frame.

12. The method as claimed in claim 10, wherein the means for automatically positioning the underwater vehicle in alignment with the dorsal ridge formed by the frame comprise an end piece of conical overall shape arranged at one end of the frame.

13. The method as claimed in claim 10, wherein the means for grasping the underwater vehicle comprise two articulated arms arranged on the frame and configured to encircle the lateral walls of the underwater vehicle.

14. The method as claimed in claim 11, wherein the means for automatically positioning the underwater vehicle in alignment with the dorsal ridge formed by the frame comprise an end piece of conical overall shape arranged at one end of the frame.

15. The method as claimed in claim 14, wherein the means for grasping the underwater vehicle comprise two articulated arms arranged on the frame and configured to encircle lateral walls of the underwater vehicle.

16. The method as claimed in claim 15, wherein the means for grasping the underwater vehicle are connected to a pulling cable.

17. The method as claimed in claim 14, wherein the means for grasping the underwater vehicle are connected to a pulling cable.

18. The method as claimed in claim 11, wherein the means for grasping the underwater vehicle are connected to a pulling cable.

* * * * *

UNITED STATES PATENT AND TRADEMARK OFFICE

CERTIFICATE OF CORRECTION

PATENT NO. : 8,590,476 B2
APPLICATION NO. : 12/995982
DATED : November 26, 2013
INVENTOR(S) : Goudeau et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 325 days.

Signed and Sealed this
Twenty-second Day of September, 2015

Michelle K. Lee

Michelle K. Lee
*Director of the United States Patent and Trademark Office*